US006402111B1

(12) United States Patent
Stewart et al.

(10) Patent No.: US 6,402,111 B1
(45) Date of Patent: Jun. 11, 2002

(54) CPU MOUNTING UNIT

(75) Inventors: Kristin M. Stewart, Redondo Beach; Molly Lee, Rosemead; Avi Bilu, Diamond Bar, all of CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 09/590,305

(22) Filed: Jun. 7, 2000

Related U.S. Application Data

(60) Provisional application No. 60/137,902, filed on Jun. 7, 1999.

(51) Int. Cl.[7] ..... A47H 1/10

(52) U.S. Cl. ..... 248/317; 248/295.11; 248/297.21; 248/298.1; 248/316.1; 248/674

(58) Field of Search ..... 248/317, 285.1, 248/265, 295.11, 298.1, 316.4, 499, 505, 297.21, 918, 924, 917, 48.1, 48.2, 245.11, 296.1; 108/144.11, 146, 143, 147.16, 147.19, 147.21, 149, 140

(56) References Cited

U.S. PATENT DOCUMENTS

| | | | | | |
|---|---|---|---|---|---|
| 2,541,434 | A | | 2/1951 | Nelson et al. | 248/210 |
| 3,030,060 | A | * | 4/1962 | Breuer | 248/265 |
| 3,567,261 | A | * | 3/1971 | Akczinski | 248/265 X |
| 4,079,604 | A | | 3/1978 | Anderegg | 70/58 |
| 4,130,069 | A | * | 12/1978 | Evans et al. | 108/136 |
| 4,179,091 | A | * | 12/1979 | Bidney | 248/295.11 X |
| 4,363,459 | A | * | 12/1982 | Holzer | 248/265 |
| 4,580,754 | A | | 4/1986 | Hughes | 248/285 |
| 5,044,589 | A | * | 9/1991 | Milne et al. | 248/265 |
| 5,131,620 | A | * | 7/1992 | Boundy | 248/505 X |
| 5,681,116 | A | | 10/1997 | Lin | 384/42 |
| 5,706,739 | A | * | 1/1998 | Shaheen et al. | 108/147 |
| 5,779,206 | A | | 7/1998 | Harris et al. | 248/214 |
| 5,884,876 | A | * | 3/1999 | Axford | 248/48.2 |
| 5,927,668 | A | * | 7/1999 | Cyrell | 248/317 |
| 6,098,944 | A | | 8/2000 | Pangborn et al. | 248/317 |

* cited by examiner

*Primary Examiner*—Leslie A. Braun
*Assistant Examiner*—Tan Le
(74) *Attorney, Agent, or Firm*—Christie, Parker & Hale, LLP

(57) ABSTRACT

A computer unit mounting holder for holding a computer under a desk top surface. The mounting holder is linearly translatable and also rotatable about an axis. The mounting unit includes vertical and horizontal adjustments for adjusting the size of a holding bracket for a variety of sizes of computer units.

17 Claims, 10 Drawing Sheets

CPU MOUNTING UNIT

This application claims the benefit of U.S. Provisional Patent Application No. 60/137,902, filed Jun. 7, 1999, the disclosure of which is incorporated by reference herein.

BACKGROUND OF THE INVENTION

The present invention relates generally to a computer unit holder, and more particularly to an adjustable under surface computer unit holder.

The use of personal computers is widespread both at the office and at home. Such widespread use of personal computers has presented challenges to furniture and furniture accessory designers and manufacturers. A primary challenge is that office and office type furniture must be adapted to meet the requirements imposed by such computer systems.

Computer systems require room for display monitors, computer units, and computer keyboards. Display monitors are often placed on a desktop surface. Computer keyboards are often placed on the desktop or extendably mounted under the desktop. Likewise, computer units are often placed about the desk on the floor or placed in a bracket under the desktop.

Placing a computer unit on the floor poses difficulties. The floor may be an unsuitable surface for placing an electronic device. Placing the computer unit on the floor outside of the desk footprint requires additional space, and may be unsightly placing the computer unit on the floor underneath the desk reduces available foot room. Moreover, placing the computer unit on the floor increases the risk that the computer unit may be kicked, bumped during floor cleaning by vacuums, or otherwise damaged.

In addition, computer units often have controls and receptacles for receiving CD-ROMs, floppy disks and the like on the front of the unit, as well as a variety of plugs and attachments in the rear of the unit. Placing the computer unit on the floor, particularly under a desk, creates difficulties in accessing of those receptacle and plugs and attachments. Positioning the computer unit to allow easy access to the front of the unit may result in difficulty in accessing the rear of the unit. Likewise, positioning the computer unit to allow easy access to the rear of the unit may result in difficulties in accessing the front of the unit.

Mounting a computer unit using brackets to the underside of a desktop also poses problems. As with positioning the computer units on the floor, obtaining access to the various parts of the computer unit may be difficult. This is particularly true if the mounting brackets are fixed in position underneath the desktop. If the mounting brackets are allowed to rotate underneath the desktop to allow greater access to the computer unit, then additional space is required under the desktop to allow for such rotation.

Mounting a computer unit to the underside of a desktop using brackets also poses problems. Computer units are often valuable, so they must be securely held when mounted off the floor. Thus, the brackets should securely hold the computer units. In addition, placing a computer in the brackets may be difficult. Computer units are sometimes difficult to lift and position, particularly when one is attempting to do so underneath a desktop surface. As the brackets themselves may require exacting adjustment prior to inserting the computer unit, adjustment of the bracket adds to the difficulties.

Further, computer units are available in a variety of sizes and dimensions. In particular, the height and width of computer units may vary significantly. Absent plans to adjust the mounting brackets for computer units of different sizes increase the difficulty of both manufacturing and purchasing mounting brackets.

SUMMARY OF THE INVENTION

Many of the attendant features of this invention will be more readily appreciated as the same becomes better understood by reference to the following detailed description considered in connection with the accompanying drawings in which like reference symbols designate like parts throughout.

The present invention therefore provides an under desk computer unit bracket. The under desk computer unit bracket includes an upper support arm. The upper support arm is adapted to be coupled to an underside of a desk. The bracket also includes a lower support arm coupled to the upper support arm. The upper support arm and the lower support arm thereby form a holding area adapted to receive a computer unit. In addition means are provided to adjust the relative position of the upper support arm and the lower support arm.

In one embodiment the upper support arm is rotatably coupled to a slide mechanism. Rotatably coupling the upper support arm to the slide mechanism allows the upper support arm to be positioned across a linear region, including forward of a desk, as well as allowing pivoting or rotation of the computer unit.

In one embodiment the bracket comprises upper and lower L-brackets. The L-brackets include a slot having notches along its edge adapted to receive positioning tabs coupled to the opposing bracket. In a further embodiment retention bands join upper and lower horizontal arms.

DETAILED DESCRIPTION

Figure 1:
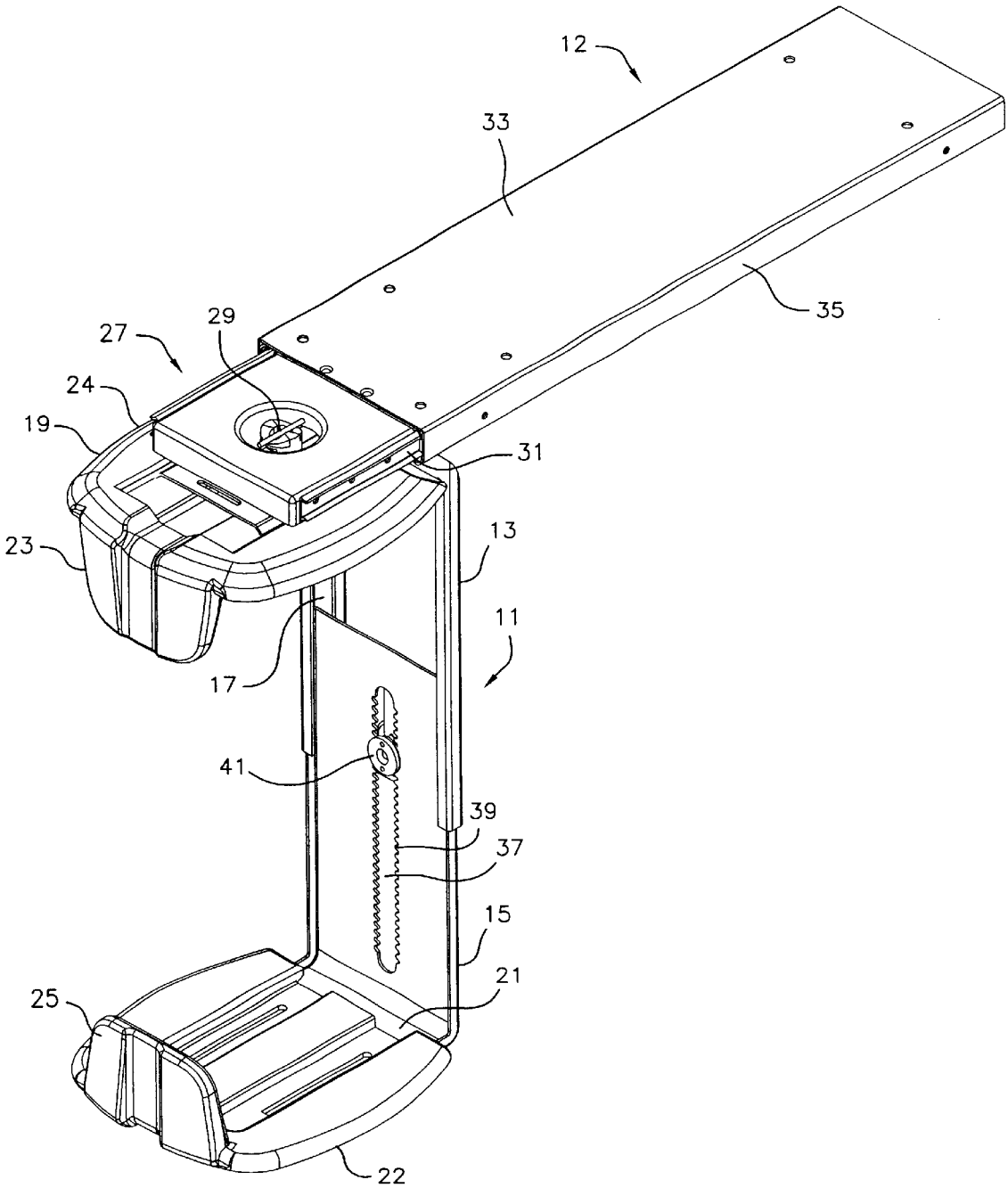
FIG. 1 illustrates a prospective view of the computer mounting unit of the present invention.

FIG. 1 illustrates a computer mounting unit of the present invention. The computer mounting unit includes a CPU holder 11. The CPU holder is coupled to a mounting bracket unit 27. The mounting bracket unit, in turn, is coupled by slides (shown in FIG. 4) to a casing 12. The casing is adapted to be mounted to the underside of a desktop or table, and the slides provide for translational movement of the CPU holder.

The CPU holder is comprised of two substantially L-shaped brackets. An upper L-shaped bracket 13 has a horizontal arm 19 and a vertical arm 13 descending from one margin of the horizontal arm. Similarly, a lower L-shaped bracket has a horizontal arm 21 with a vertical arm 15 ascending from one margin of the horizontal arm.

The vertical arm of the upper and lower L-shaped brackets are adapted to be mated together. This is accomplished by forming a U-shaped channel 17 along both sides of the vertical arm of the upper L-shaped bracket. The vertical arm of the lower L-shaped bracket, which is substantially flat, has a width slightly less than the distance between the bases of the opposing U-shaped channels. Thus, the vertical arm of the lower L-shaped bracket is positioned within the U-shaped channels of the vertical arm of the upper L-shaped bracket.

Mounted to the vertical arms of both the upper and lower L-shaped brackets are grips 22, 24. In the embodiment described, the grips are plastic. The grips include forward edges 23, ?5. The forward edges are opposing forward edges in that they extend toward one another when the grips are mounted to the L-shaped brackets. The grips additionally include slots adapted to receive the horizontal arms of the L-shaped brackets. Placing the horizontal arms of the L-shaped brackets in the slots allows for positioning of the grips at various positions with respect to the L-shaped brackets. This allows the forward edges of the grips to be placed at different distances from the vertical arms of the L-shaped brackets, thereby allowing the CPU holder to be adjusted for computer units of various widths.

The vertical arm of the L-shaped bracket is coupled to the mounting bracket unit 27. The mounting bracket unit, and various embodiments thereof, are more fully described in U.S. patent application Ser. No. 09/377,208 entitled "Extendable Swivel Mounting Bracket", filed on Jun. 7, 1999 and commonly assigned to the assignee of the present invention, the disclosure of which is incorporated herein by reference. As discussed more fully in the above-mentioned patent application, the mounting bracket unit includes a disk mounted to the vertical arm of the upper L-shaped bracket. The disk is positioned within a bracket which includes a locking mechanism 29. The locking mechanism keeps the dish securely positioned within the bracket, but does not prevent rotation of the disk. In one embodiment, and as more fully described in the above referenced application, the locking mechanism includes a key lock. A plunger type key lock, or other locks, which restricts movement of the disk through insertion of a pin into or behind the disk securely maintains the disk, and therefore the CPU unit, in the bracket. Accordingly, the mounting bracket allows the CPU holder to rotate or swivel. The bracket is coupled to slides 31. The slides couple the mounting bracket unit to the casing 12.

The casing includes a substantially flat rectangular top 33 with opposing sides 35 descending from opposing margins of the rectangular top. The slides are coupled to the opposing sides, and thereby allow the mounting bracket unit, and therefore the CPU holder, to be positioned at a variety of linear locations with respect to the casing. The CPU holder is therefore both linearly moveable and rotatable. In alternative embodiments, however, the CPU holder is attached to a fixed bracket under, for example, a desktop.

The vertical arms of the CPU holder also include means to vary the vertical distance between the grips, i.e., the height, of the CPU holder. This means includes a mechanism for placing tabs coupled to one vertical arm in cutouts, apertures, notches and the like in the other vertical arm.

In the embodiment illustrated in FIG. 1, the vertical arm of the lower L-shaped bracket includes a vertical slot 37. Notches 39 are provided on each side along the length of the slot. The notches are placed such that a notch on one side of this slot has a corresponding notch at the same relative position on the opposing side of the slot.

In one embodiment, the slot includes a lower and/or upper end of increased width. Increasing the width of the slot and a portion thereof allows the positioning disk to be passed through the portion of the slot with increased width. This allows a upper and lower L-shaped brackets to be assembled after the positioning disk has been coupled to the vertical arm of the upper L-shaped bracket. A positioning disk 41 is coupled to the vertical arm of the upper L-shaped bracket. Protrusions on the positioning disk are positionable in the notches, as may be more fully understood in conjunction with FIGS. 2 and 3.

Figure 2:
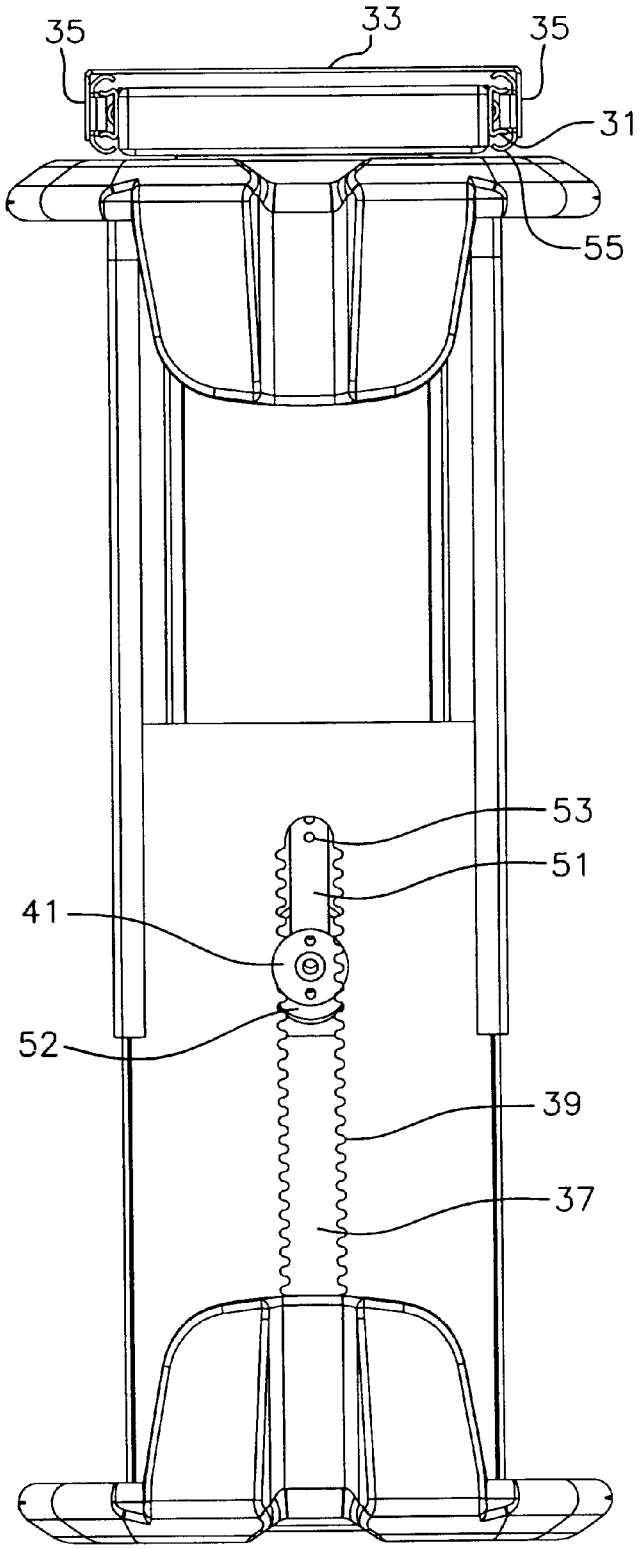
FIG. 2 illustrates a front view of the computer mounting unit of FIG. 1.

FIG. 2 illustrates a front view of the computer mounting unit of FIG. 1. As illustrated in FIG. 2, a leaf spring 51 formed of a metal strip is affixed to the vertical arm of the upper L-shaped bracket using rivets 53. The leaf spring is attached to the surface of the vertical arm on the side adjacent to the vertical arm of the lower L-shaped bracket when the L-shaped brackets are coupled together. A free end of the leaf spring is positioned such that they are placed over an aperture 52 in the vertical arm of the upper L-shaped bracket. The free end of the leaf spring may therefore be biased away from the vertical surface of the upper L-shaped bracket by pressing through the aperture against the free end. The leaf spring is also attached to the vertical arm of the upper L-shaped bracket such that the leaf spring, pushed from the aperture 52 moves towards and through the slot in the vertical arm of the lower L-shaped bracket. In its unbiased position, however, the leaf spring remains stably between the vertical arms of the L-shaped bracket.

The positioning disk 41 is coupled to the free end of the leaf spring. The positioning disk is positioned on the side of the vertical arm of the lower L-shaped bracket away from the vertical arm of the upper L-shaped bracket. As the positioning disk is affixed to the leaf spring, the positioning disk is normally biased towards the vertical arm of the lower L-shaped bracket. In other embodiments, however, the leaf spring is replaced by other types of springs.

Figure 3:
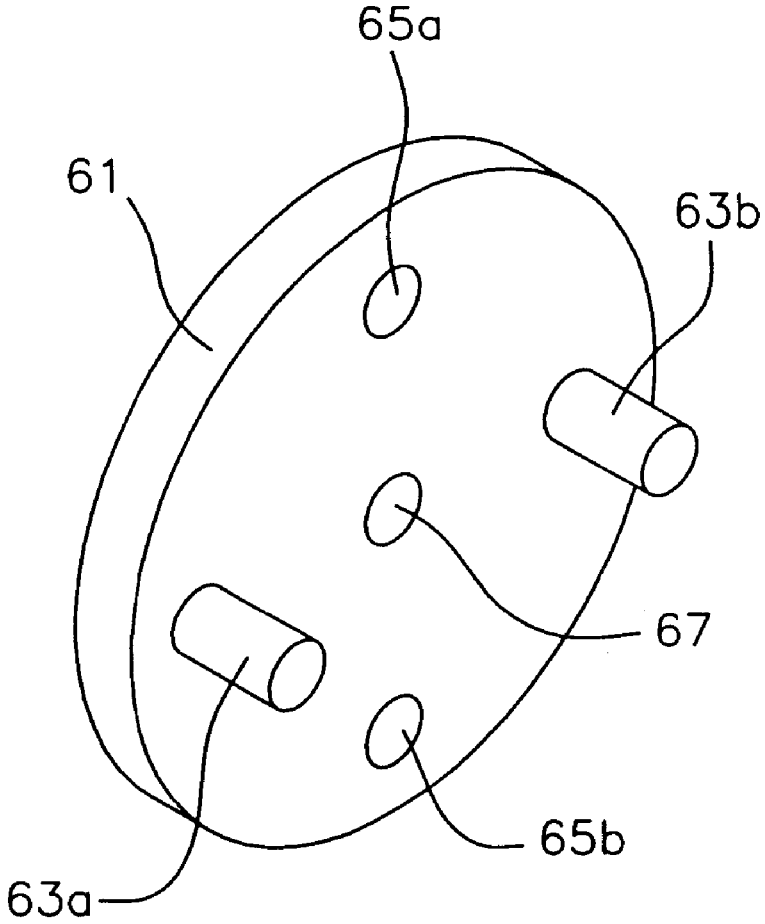
FIG. 3 illustrates a perspective view of a positioning disk of the computer mounting unit of FIG. 1.

FIG. 3 illustrates additional details regarding the positioning disk. The positioning disk is substantially a plate. In the embodiment shown, the positioning disk is a coin-shaped disk. The positioning disk includes a central aperture 67 which is used, as will later be described, for attachment of a positioning button. The positioning disk also includes leaf spring attachment apertures 65*a,b*. These apertures are used to allow rivets or other attachment structures to pass through the positioning disk to allow attachment of the positioning disk to the leaf spring. In addition, the positioning disk has positioning tabs 63*a,b* on either side of the central aperture. The positioning tabs are substantially cylindrical protrusions extending from one surface of the positioning disk. The positioning tabs are adapted to be positioned in the notches 39 in the vertical arm of the lower L-shaped bracket.

Therefore, the leaf spring tends to force the positioning disk against the vertical arm of the lower L-shaped bracket.

With the positioning disk so positioned, the positioning tabs are biased through the notches formed along the opposing sides of the vertical slot. As the positioning disk is attached, via the leaf spring, to the vertical arm of the upper L-shaped bracket, the positioning tabs serve to hold the upper and lower L-shaped brackets in vertical position with respect to one another.

Figure 4:
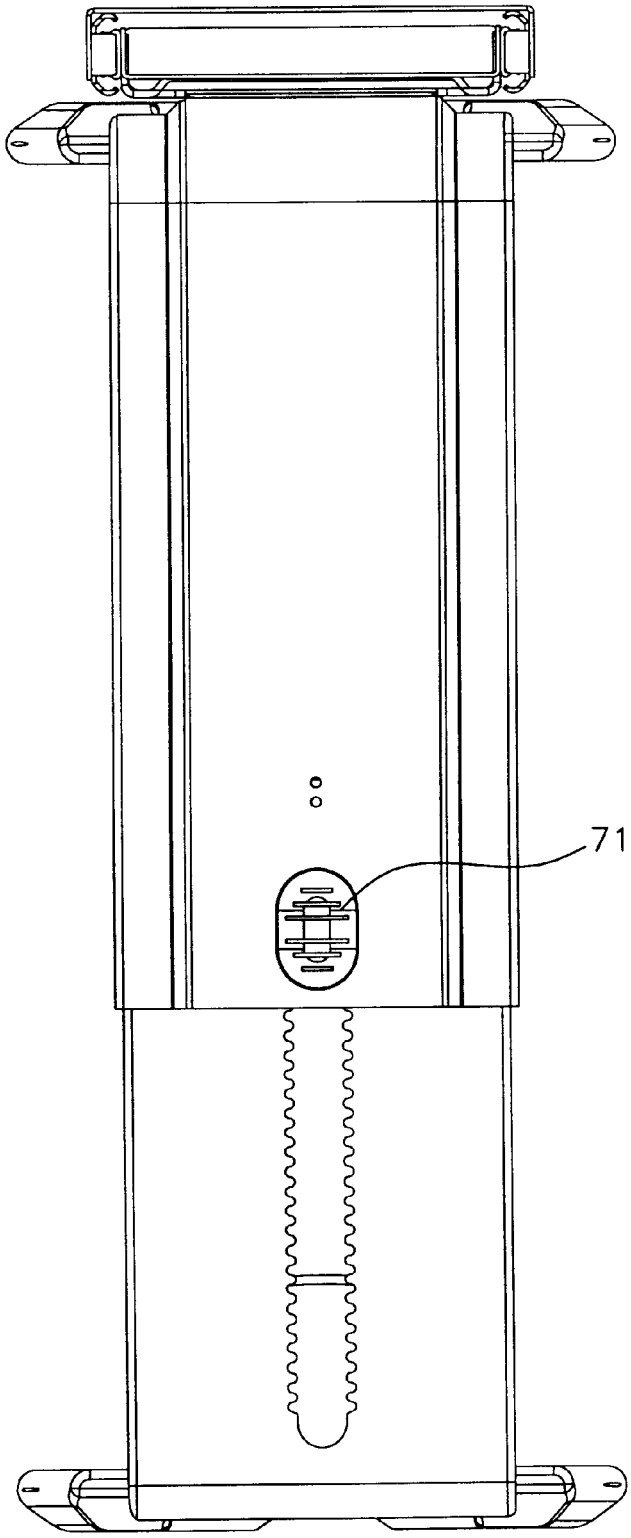
FIG. 4 illustrates a back view of the computer mounting unit of FIG. 1.

FIG. 4 illustrates a rear view of the computer mounting unit of FIG. 1. Specifically, FIG. 4 illustrates a positioning button 71 coupled to the lower rear of the vertical arm of the upper L-shaped bracket. The positioning button is polymeric, and has at least a portion extendable through the aperture 52 in the vertical arm of the upper L-shaped bracket. As previously alluded to, the positioning button is coupled, through the leaf spring, to the positioning disk. In operation, depression of the mounting button 71 causes the leaf spring and the positioning disk to bias forward with the result that the positioning pins are positioned forward of the vertical arm of the lower L-shaped bracket. The positioning pins therefore are not positioned in the notches, and the upper and lower L-shaped brackets may be repositioned with respect to one another. This allows the horizontal arms and the grips to be positioned at different distances with respect to one another, with the result that the CPU holder is able to hold CPU units of a variety of sizes.

In an alternative embodiment the positioning button includes a self resetting camming surface adjacent the leaf spring. The camming surface results in the button undergoing a twisting motion as the button release and the positioning disk pins ride into the notches. As the button twists an extension, such as a flange, extending from the button latches behind the vertical surface of the upper L-bracket. This latching prevents depression of the button, and release of the positioning disk, until the button is twisted to remove the extension from behind the vertical surface.

Returning now to FIG. 2, the CPU holder is extendable from the casing using slides. In the embodiment described telescopic drawer slides couple the mounting bracket affixed to the CPU holder to the casing. More specifically, the opposing sides 35 of the casing have an outer slide member of a telescopic slide attached thereto. An inner member 31 is in turn affixed to sides of the mounting bracket. The inner member and the outer member, as common in the art, are slidably, or rollably, coupled by bearings. Thus, the CPU holder may be extended to a position forward of the casing, or retracted to a position well underneath the casing.

In addition the mounting bracket allows the CPU holder to rotate, or swivel, with respect to the mounting bracket. As necessary, therefore, a computer unit held by the CPU holder is extendable linearly under, and potentially forward of, the desk top surface. Moreover, the CPU holder and the CPU may also be rotated to allow for easy access of both the front and the rear of the computer unit. Allowing for rotation of the CPU holder when it is positioned forward of the casing, and, depending on the location of the casing, forward of the desk allows the assembly to be mounted closer to the sides of the desk. Also access to the front and/or rear of the unit may still be easily accomplished by extending the CPU holder forward of the desk prior to rotation.

Figure 5:
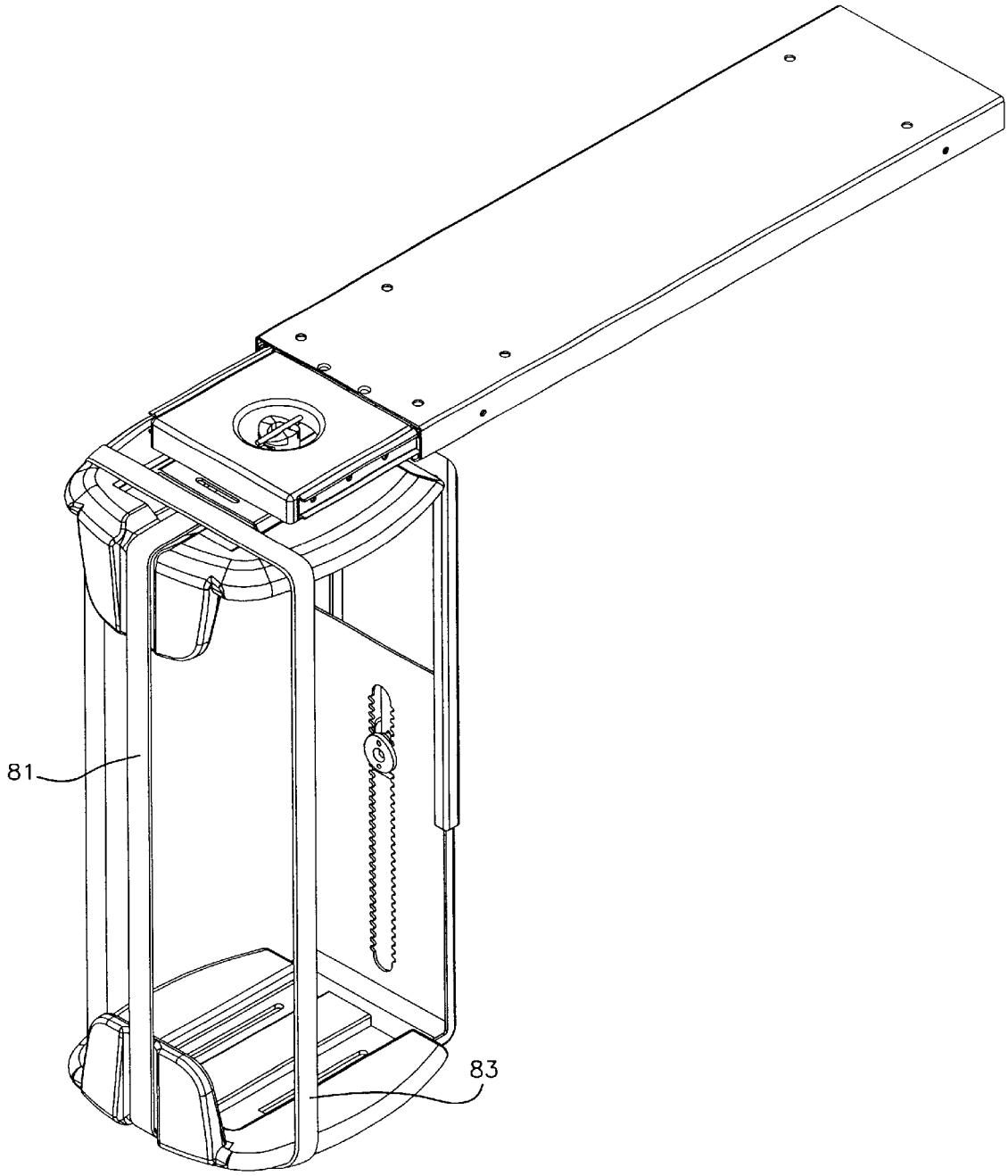
FIG. 5 illustrates an alternative embodiment of the computer mounting unit he present invention having retention straps.

FIG. 5 illustrates another embodiment of the computer mounting unit. The computer mounting unit of FIG. 5 is similar to that of FIG. 1. The computer mounting unit of FIG. 5, however, additionally includes security or retention, straps 81 and 83. Each of the security straps 81 are comprised of two Velcro strips. The first Velcro strip is attached to the top and forward edge of the grip on the upper L-shaped bracket. The second strip is affixed to the lower surface of the grip attached to the lower L-shaped bracket. In one embodiment the upper strip is sufficiently long that it reaches the lower grip no matter the distance between the two grips, and attaches to Velcro affixed to the lower grip. In other embodiments, the Velcro strips are both long and may be placed together anywhere along the side of the computer unit. Moreover, in one embodiment a single Velcro strip is used. The Velcro strip is mounted to a horizontal surface of an L-bracket and passed through a loop or slot on the opposing horizontal surface of the opposing L-bracket. When the Velcro strip is mounted inset of the width of a computer unit, the computer unit is positively retained in position by the Velcro strip.

Similarly, the security straps 83 extend from the along the sides of the upper and lower surfaces of the grips. This allows sideways movement of the computer unit to also be restricted.

Figure 6:
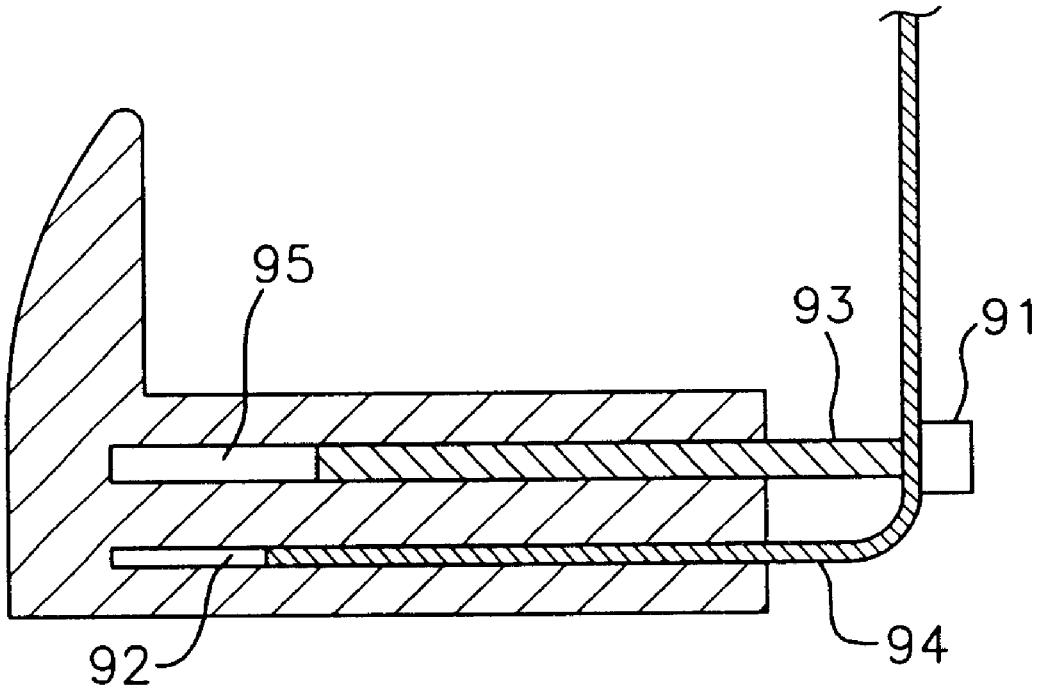
FIG. 6 illustrates a cross-section view of an alternative embodiment of the lower support arm and grip including positive positioning means.

FIG. 6 illustrates a cross sectional view of the lower L-shaped bracket and grip of one embodiment of the present invention. As illustrated in FIG. 6, the grip has a slot 92 into which is positioned the horizontal arm 94. The grip also includes a threaded hole 95. A set screw 93 is passed through an aperture in the vertical arm of the lower L-shaped bracket and into the threaded hole. A thumb wheel 91 is attached to the set screw on the opposite side of the vertical arm then the grip. Rotation of the thumb wheel, therefore, causes the grip to move either away from or towards the vertical arm. Other methods for modifying the relative position of the vertical arm and the grip are also known. For example, a grip may be formed of two separate pieces, with various screw and rib type mechanisms therein.

Figure 7:
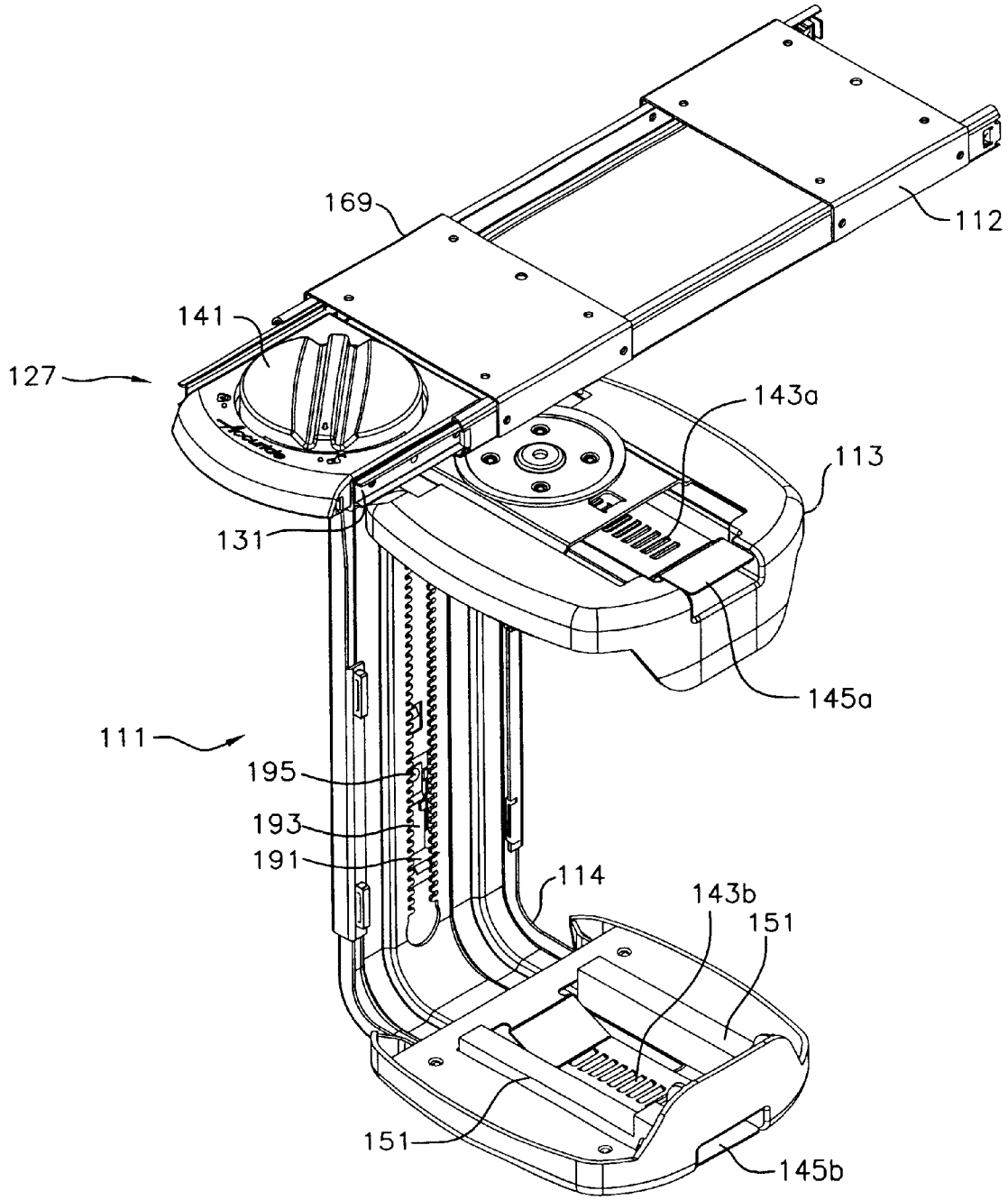
FIG. 7 illustrates a perspective view of an alternative embodiment of a CPU mounting unit in accordance with the present invention.

FIG. 7 illustrates an alternate embodiment of a CPU mounting unit in accordance with the present invention. The alternate embodiment of FIG. 7 includes a CPU holder 111. The CPU holder is coupled to a mounting bracket unit 127. The mounting bracket unit, in turn is coupled by slides 131 to a casing 112.

As with the computer mounting unit of FIG. 1, the CPU holder is comprised of two substantially L-shaped brackets, including an upper L-shaped bracket 113 and a lower L-shaped bracket 114. Of specific interest, in the embodiment of FIG. 7, the CPU holder includes a locking cap 141, and width adjust mechanisms 143*a*, 143*b*. The locking cap conveniently allows the swivel disk to be locked into place by way of a plunger, as well as to hold the slides in an extended position when the plunger is not locking the swivel disk. The width adjust mechanisms allow the grips on the CPU holder to be easily repositioned. The embodiment of FIG. 7 also includes foam pads 151 on the grips to account for variations in CPU casing sizes.

Figure 8:
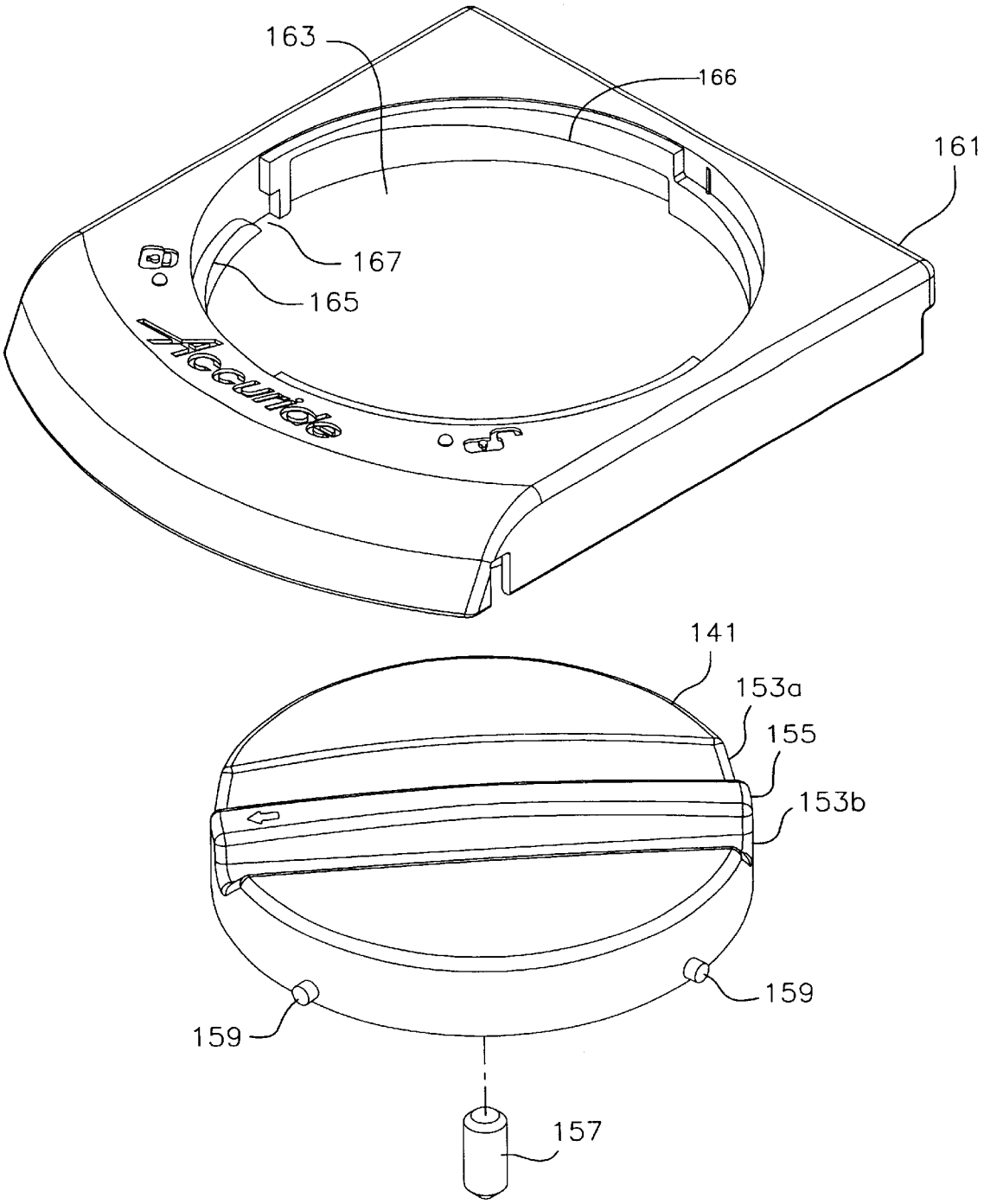
FIG. 8 illustrates a locking cap and locking cap assembly of the embodiment of FIG. 7.

FIG. 8 illustrates details of the locking cap. The locking cap 141 is substantially disk shaped. The top of the locking cap includes two slots 153*a,b* that are substantially parallel and form a raised portion forming a handle 155 which extends across the diameter of the top of the locking cap. The bottom of the locking cap includes a plunger 157. The plunger is adapted to engage an emboss on top of the swivel disk. About the edge of the locking cap are four symmetrically placed pegs 159.

The locking cap is adapted to be inserted in a cap assembly 161. The cap assembly is a rectangular block with a central circular cut out 163 adapted to receive the locking cap. The edge of the circular cut out includes four sloped ramps, two lower sloped ramps 165 and two upper sloped ramps 166. When viewing the cap assembly from above (as viewed in FIG. 8), the sloped ramps increase in height in a counter clockwise manner, with the lower and upper sloped ramps being interspersed. Between the lower end of the lower sloped ramps and the upper end of the upper sloped ramp is a notch 167 or cut-out.

The cap is inserted into the cap assembly from the underside of the cap assembly, with two of the pegs passing through the cut outs to ride on the upper side of the lower sloped ramps and two of the pegs riding along the bottom of the upper sloped ramps. In normal operation the locking cap is recessed within the cap assembly and the plunger extends down into an emboss on the swivel disk. As the locking cap is somewhat recessed in normal operation, the locking cap does not hit a desk top or the casing 169 (shown in FIG. 7), and the slides may therefore freely move back and forth.

Twisting the locking cap, however, causes the pegs to ride up the sloped ramps, thereby pulling the plunger out of the emboss on the swivel disk. Moreover, the locking cap extends from the cap assembly and prohibits movement of the slides as the locking cap in the raised position has its movement obstructed by the desk and/or casing. Thus, with the plunger and the emboss of the swivel disk the swivel disk is locked into place and the CPU holder is firmly held to the slides and casing. The slides may be extended and retracted to allow convenient positioning of the CPU holder. With the locking cap rotated to remove the plunger from the emboss of the swivel disk, however, the slides are not allowed to retract so that removal of the CPU holder, or attachment of the CPU holder former to the swivel disk, may be conveniently accomplished. In addition, twisting the locking cap the opposite direction or counter-rotating the locking cap, drives the plunger back into the emboss due to the pegs riding along the bottom of the upper sloped ramps.

Figure 9:
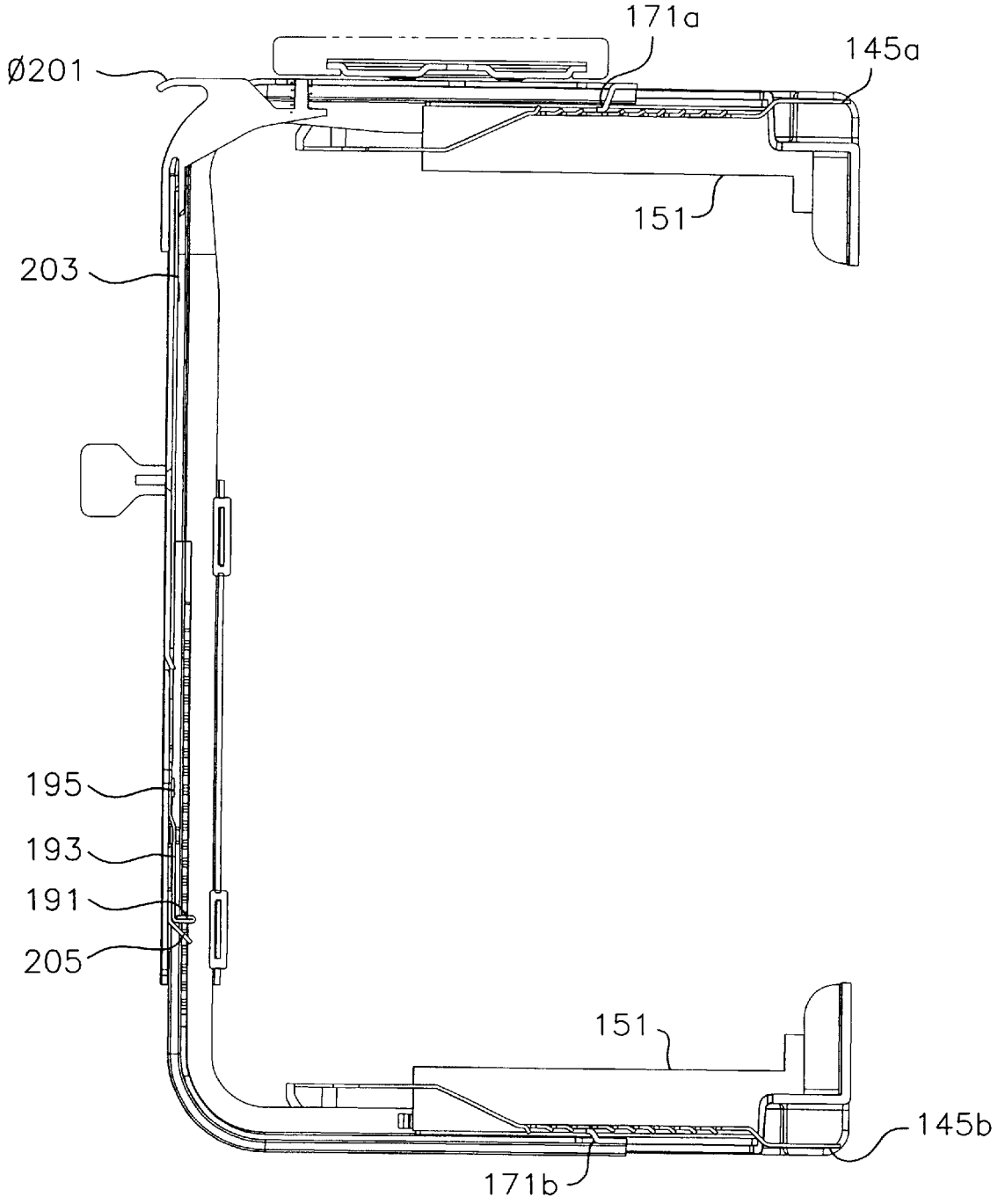
FIG. 9 illustrates a cross-sectional side view of the embodiment of FIG. 7.

FIG. 9 illustrates a cross-sectional side view of the CPU holder of FIG. 7. As can be seen in FIG. 9, the foam pads 151 extend across much of the length of the grips, and also extend slightly along the vertical edges of the grips to allow for variations in CPU casing sizes.

The cross-sectional side view of FIG. 9 also more clearly shows the width adjustment handles, 145*a,b*. The width adjust handles extend outward into a recess of the grip (as may be seen in FIG. 7). The width adjust handles are at the end of arms attached to a portion of the grip towards the vertical portions of the L-shaped bracket. In the embodiment described, the arms are comprised of metal, although in alternative embodiments the arms are foam of plastic.

Teeth are formed along the length of the arm. The teeth are adapted to engage an upturned metal tab, 171*a,b* on the horizontal portions of the L-shaped brackets. Due to the mounting of the arms to the grip, the arms are normally biased so that the teeth are engaged by the upturned tab. Pressing the width adjust handles, however, causes the teeth to displace away from the tab and allows the grips to move relative to the L-shaped bracket. Conveniently, the teeth are angled away from the horizontal portion of the L-shaped brackets, and the tab is angled towards the horizontal portion of the L-shaped brackets. This allows the grips to be easily moved closer to the horizontal portion of the L-shaped bracket without use of the width adjust handles, thereby allowing the grips to be easily positioned to snugly fit against the CPU casing. Once the grips are snugly placed against the CPU casing, however, use of the width adjust handles to displace the teeth away from the metal tab is required to release the CPU casing from the CPU holder.

A cross-sectional view of FIG. 9 also shows details of an alternative height adjust mechanism. The height adjust mechanism allows the two L-shaped brackets forming the CPU holder to be moved with respect to one another. Returning briefly to FIG. 7, the L-shaped brackets are maintained in relative position to one another by a tab 191 which rests in notches of a cut out, with a widened "finger" hole at the lower end to allow for manual emergency repositioning, in the lower L-shaped bracket. The tab is at the end of a leaf spring 193 mounted by a rivet 195 to the upper L-shaped bracket.

As seen in both FIGS. 7 and 9, connected to the upper L-shaped bracket is a height adjustment lever 201, which is attached a height adjust strap 203. The height adjust strap, in the embodiment described, is formed of metal and extends down along the vertical length of the upper L bracket. The height adjust strap terminates at an angled ramp 205. The length of the height adjust strap is such that the angled ramp is just below a tab used to adjust the position of the upper and lower L-shaped brackets.

Lifting the height adjust lever causes the height adjustment strap to move upward, thereby causing the ramp to bias the tab forward. Biasing the tab forward causes the tab to no longer rest in the notches of the lower L-shaped bracket, and the lower L-shaped bracket is therefore free to slide up and down with respect to the upper L-shaped bracket. Thus, raising the height adjust lever causes the tab to bias out of the notches and thereby allow relative movement of the upper and lower L-shaped brackets to account for a variety of CPU casing sizes.

Figure 10:
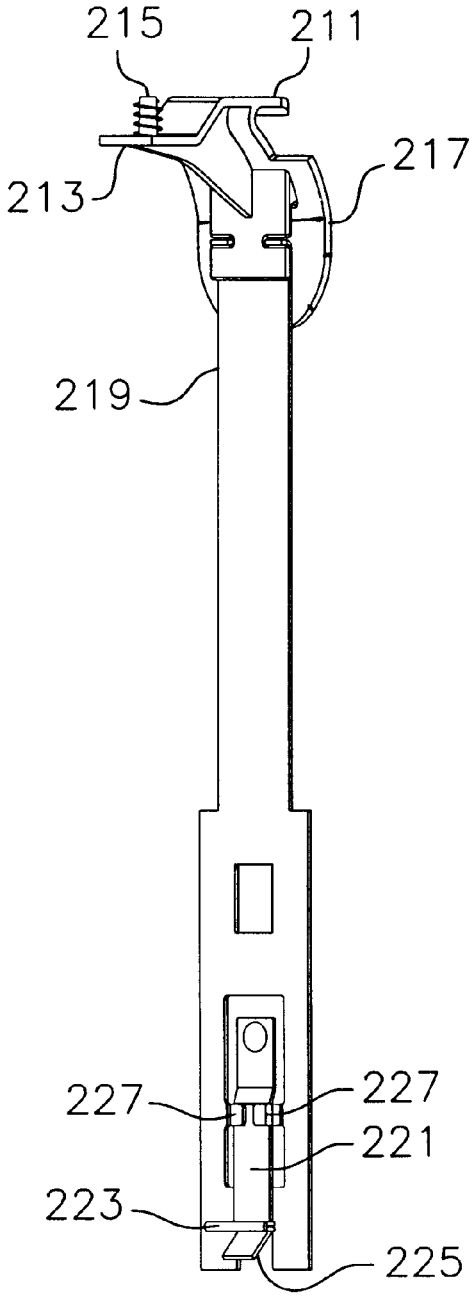
FIG. 10 illustrates a perspective view of a height adjustment mechanism of the embodiment of FIG. 7

FIG. 10 shows additional details of the height adjustment lever, height adjustment strap, as well as the positioning tab and leaf spring. The height adjustment lever includes a handle 211. Extending forward of the handle is a nose 213, with a peg 215 extending upwards from the nose. Extending down from the handle is a cape 217 and, somewhat in parallel, the height adjust strap 219. The cape and the height adjust strap are slightly offset so that the vertical portion of the upper L-shaped bracket is sandwiched between the cape and the height adjust strap. The cape and the height adjust strap therefore maintain position of the locking lever and height adjust strap in the plane of the vertical portion of the upper L-shaped bracket.

Although shown together in FIG. 10, the height adjust strap and the leaf spring 221 with extending tab 223 for positioning the upper and lower L-shaped brackets are separate units. The tab on the leaf spring, as illustrated, is positioned slightly above the ramp 225 at the bottom of the height strap. When the height adjustment lever is pulled upward the ramp biases the leaf spring forward. As the leaf spring is narrower than the slot in the lower L-shaped bracket, while the tab at the bottom of the leaf spring is wider than the slot in the lower L-shaped bracket, biasing the tab forward allows the leaf spring to be pressed into the slot and allows movement of the upper L-shaped bracket. As both the height adjustment lever, and therefore the height adjustment strap, and the leaf spring are coupled to the upper L-shaped bracket the relative position of these items are maintained during motion of the upper L-shaped bracket. Also as shown in FIG. 10, the height adjustment straps includes safety tabs 227. The safety tabs extend slightly forward from the locking strap, and extend in front of the leaf spring. The safety tabs prevent excessive motion of the leaf spring, as well as reduce wear on the rivet holding the leaf spring to the upper L-shaped bracket.

Two features are used to ensure that the height adjust lever is not inadvertently positioned to allow movement of the upper and lower L-shaped brackets. A first feature is illustrated in FIG. 9, as well as in FIG. 10. As can be seen in FIG. 9, a forward end of the height adjust lever includes a spring mounted vertically on a peg of the height adjustment lever. The peg is positioned to pass through an aperture on the upper L-shaped bracket. As the peg passes through the aperture, the spring is forced to compress. Compression of the spring biases the height adjustment lever downward. Accordingly, the spring exerts a force to bias the height adjustment lever towards a position where the ramp at the end of the height adjustment strap does not bias the tab out of the notch. A further mechanism to prevent inadvertent adjustment of the relative positioning of the upper and lower L-shaped brackets is the position of the aperture through which the peg on the height adjustment lever passes. As can be seen in FIG. 9, without the locking cap assembly present the peg is free to move through the aperture in the upper L-shaped bracket. When the swivel disk is placed in the swivel disk mounting bracket (indicated in dashed lines), however, the mounting bracket prevents upward motion of the peg through the aperture. Thus, once the CPU holder is mounted in the mounting bracket, the height adjustment lever can not be inadvertently used to modify the relative position of the upper and lower L-shaped brackets, and the CPU casing is therefore securely held in place. In addition, a mushroom handle is affixed to the rear of the vertical portion of the upper L-shaped bracket to allow for ease of swiveling and so forth.

Accordingly, the present invention provides a CPU mounting unit. Although this invention has been described in certain specific embodiments, many additional modifications and variations would be apparent to those skilled in the art. It is therefore to be understood that this invention may be practiced otherwise than as specifically described. Thus, the present embodiments of the invention should be considered as illustrative and not restrictive, the scope of the invention to be indicated by the claims and their equivalents supported by this application rather than the foregoing description.

What is claimed is:

1. An underdesk computer unit bracket comprising:

a casing, the casing being adapted to be coupled to the underside of a desk;

an upper support arm slidably coupled to the casing by at least one slide;

a lower support arm coupled to the upper support arm, the upper support arm and the lower support arm forming an area adapted to receive a computer unit;

first adjustment means for adjusting the relative position of the lower support arm and the upper support arm; and second adjustment means for adjusting the position of the upper support arm and the lower support arm with respect to the desk, the first adjustment means and the second adjustment means being independently operable.

2. An underdesk computer unit bracket comprising:

an upper L-bracket having an upper horizontal arm and a descending vertical wall, the descending vertical wall including opposing U-shaped channels;

a lower L-bracket having a lower horizontal arm and an ascending vertical side, the ascending vertical side having edges at least partially within the opposing U-shaped channels and a vertical slot having notches along its edges;

a plate coupled to the descending vertical wall, the plate having a protrusion adapted to engage the notches, the plate being biased so as to maintain the protrusion in the notches by a spring biasing the plate.

3. The underdesk computer unit bracket of claim 2 further comprising at least one slide coupled to the upper L-bracket and adapted to be coupled to an underside of a desk.

4. The underdesk computer unit bracket of claim 2 further comprising a mounting bracket rotatably coupled to the upper L-bracket, the mounting bracket adapted to be coupled to an underside of a desk.

5. The underdesk computer unit bracket of claim 2 further comprising a mounting bracket rotatably coupled to the upper L-bracket and coupled to at least one slide, the slide being adapted to be coupled to an underside of a desk.

6. The underdesk computer unit bracket of claim 5 further comprising a casing, the casing being coupled to the at least one slide and being adapted for coupling to an underside of a desk.

7. The underdesk computer unit bracket of claim 6 further comprising retention bands joining the upper horizontal arm and the lower horizontal arm.

8. The underdesk computer unit bracket of claim 7 wherein the spring is a leaf spring.

9. The underdesk computer unit bracket of claim 8 wherein the spring couples the plate to the descending vertical wall.

10. An undersurface computer unit bracket comprising:

an upper L-bracket having an upper horizontal arm and a descending vertical wall, the descending vertical wall including opposing U-shaped channels;

a lower L-bracket having a lower horizontal arm and an ascending vertical side, the ascending vertical side having edges at least partially within the opposing U-shaped channels and a vertical slot having notches along its edges;

a plate coupled to the descending vertical wall the plate having a protrusion adapted to engage the notches, the plate being biased so as to maintain the protrusion in the notches by a spring biasing the plate.

11. The undersurface computer unit bracket of claim 10 further comprising at least one slide coupled to the upper L-bracket and adapted to be coupled to an underside of a surface.

12. The undersurface computer unit bracket of claim 10 further comprising a mounting bracket rotatably coupled to the upper L-bracket, the mounting bracket adapted to be coupled to an underside of a surface.

13. The undersurface computer unit bracket of claim 10 further comprising a mounting bracket rotatably coupled to the upper L-bracket and coupled to at least one slide, the slide being adapted to be coupled to an underside of a surface.

14. The undersurface computer unit bracket of claim 13 further comprising a casing, the casing being coupled to the at least one slide and being adapted for coupling to an underside of a surface.

15. The undersurface computer unit bracket of claim 14 further comprising retention bands joining the upper horizontal arm and the lower horizontal arm.

16. The undersurface computer unit bracket of claim 15 wherein the spring is a leaf spring.

17. The undersurface computer unit bracket of claim 16 wherein the spring couples the plate to the descending vertical wall.

* * * * *